United States Patent [19]

Pilié et al.

[11] Patent Number: 4,485,534

[45] Date of Patent: Dec. 4, 1984

[54] INTERCHANGE MECHANISM FOR MULTIPLE FASTENERS

[75] Inventors: Roland J. Pilié, Williamsville; Albert S. Baum, Eggertsville; Anthony L. Russo, Elma, all of N.Y.

[73] Assignee: Calspan Corporation, Buffalo, N.Y.

[21] Appl. No.: 452,658

[22] Filed: Dec. 23, 1982

[51] Int. Cl.[3] ..... A44B 19/00

[52] U.S. Cl. ..... 24/384; 24/382

[58] Field of Search ..... 24/382, 384; 2/2, 2.1 R, 2/2.1 A; 312/1; 128/1 R

[56] References Cited

U.S. PATENT DOCUMENTS

| | | | |
|---|---|---|---|
| 2,693,013 | 11/1954 | Gossner | 24/384 |
| 2,717,437 | 9/1955 | De Mestral | 28/72 |
| 2,813,022 | 11/1957 | Moulthrop | 2/2 |
| 3,355,230 | 11/1967 | Trexler | 312/1 |
| 3,439,966 | 4/1969 | Perkins et al. | 312/1 |
| 3,501,213 | 3/1970 | Trexler | 312/1 |
| 3,526,065 | 9/1970 | Hagar et al. | 52/27 |
| 3,568,276 | 3/1971 | Morgan | 24/384 |
| 3,670,718 | 6/1972 | Brendgord | 128/1 R |
| 3,744,055 | 7/1973 | Brendgord | 2/2 |
| 3,802,416 | 4/1974 | Cazalis | 128/1 R |
| 4,302,848 | 12/1981 | Otsuka et al. | 2/2 |

FOREIGN PATENT DOCUMENTS

| | | | |
|---|---|---|---|
| 63760 | 7/1941 | Norway | 24/382 |
| 1000674 | 8/1965 | United Kingdom . | |
| 1510036 | 9/1976 | United Kingdom | 24/382 |

*Primary Examiner*—Francis K. Zugel
*Assistant Examiner*—Peter A. Aschenbrenner
*Attorney, Agent, or Firm*—Biebel, French & Nauman

[57] ABSTRACT

A method and apparatus is provided for attaching and detaching two flexible panels, each of which has an opening defined by mating parts of a continuous flexible fastener strip. An elongated slide member has four generally elongated passages which includes merging parts at one end thereof to receive the fastener strip parts. The passages separate in the central part of the slide member, twist 90°, and have parts merging different ones of the passages at the other end of the slide member to bring the fastener strips into contiguous relation with their mating parts arranged such that one part of each fastener strip is mated with an opposite part of the other fastener strip by moving the slide member along the strips, simultaneously and progressively separating the mating parts of the fastener strips and joining the parts of one fastener with opposite parts of the other fastener. Joining and/or separating the edges of the two openings is accomplished to form and/or close a distendable passage through the panels which is defined by the parts of the two joined fastener strips. The slide member may include a separable secondary slide cooperable with one of the fastener strips and capable of (a) joining with the main slide member to assist in transfer of the fastener parts, or (b) operating on the parts of one fastener strip independently of the main slide member.

6 Claims, 13 Drawing Figures

11'
12'
13'
14'
15'
40
45
50
51
55
56
21'
22'
23'
24

INTERCHANGE MECHANISM FOR MULTIPLE FASTENERS

BACKGROUND OF THE INVENTION

The conventional zipper fastener used in a variety of clothing articles and other products has evolved into a number of fastener systems. One line of development is exemplified by U.S. Pat. Nos. 3,990,130, 4,308,644, 4,275,467, and 3,924,305 in which air or water tightness had been the objective. Extra flaps of material are used many times to obtain such a fluid tight seal. Others have used the extra flaps in a more aesthetic manner, such as to conceal the zipper teeth and slide mechanism. In addition, these extra flaps can be used for protective means. Boots, jackets, gloves, pants, etc. employ these various ideas to protect an inner environment (e.g., a person's body) from the external elements.

Another development of the basic zipper concept is set forth in U.S. Pat. No. 2,229,216, where a pair of slides are joined into a component to allow for a double-sealing mechanism of extra strength and durability. This type of double slide component has been employed in articles that use a removable interior liner of some sort, or that require extra strength in the fastener system.

This invention relates to joining and separating pairs of fasteners in a simplified manner, for example to open and close passages between separate items or volumes. Many products have need to attain this versatility, of which sleeping bags, tents, or other devices having one or more flexible wall or panel members, are typical examples. Consumers may purchase sleeping bags individually only to discover later the separate bags cannot be connected since the zippers are incompatible. As a solution, compatible zippers have been used so that one may join a pair of bags together, thus doubling the contained sleeping space, or one may retain the sleeping bags as separate members. Similarly, one might create a larger tent by attaching an addition to the original tent. Once again zippers or other compatible connectors can be used to achieve this objective.

SUMMARY OF THE INVENTION

This invention relates to the art of fastener systems, more specifically to those which employ a compatible pair of fasteners. Using a pair of compatible zipper type fasteners, the invention simultaneously joins or separates two flexible panels, each of which is provided with an opening controlled by one of the fasteners. A slider according to the invention combines the pair of fasteners in such a manner that while the fastener pairs are being opened at one end of the slider, opposite adjacent members of those pairs are being joined together at the opposite end. To achieve this, the slide member embraces both fasteners and disconnects the zipper tape pairs in the conventional manner, but then the tape members are twisted or rotated 90° before reattachment. The 90° rotation causes each tape member from one pair to be aligned with a mating tape member from the other pair, to which it is then joined.

The primary object of the invention is to provide a method and apparatus for attaching and detaching two flexible panels, each of said panels being provided with an opening and the sides of said openings including mating parts of a continuous flexible fastener strip, wherein a slide member having four separate passages is constructed and arranged to bring the fastener strips into contiguous relation, with the mating parts arranged such that one part of each fastener strip is capable of mating with an opposite part of the other fastener strip, by simultaneously and progressively separating the mating parts of the fastener strips and joining the parts with opposite parts of the other fastener strip in response to movement of the slide member along the fastener strips with the strips engaged in passages of the slide member, whereby joining and/or separating the edges of the two openings is accomplished to form and/or close a distendable passage through the panels, the passage being defined by the parts of the two joined fastener strips.

These and other objectives will be best understood from the following drawings, description of the preferred embodiment and appended claims.

DESCRIPTION OF THE PREFERRED EMBODIMENTS

Figure 1:
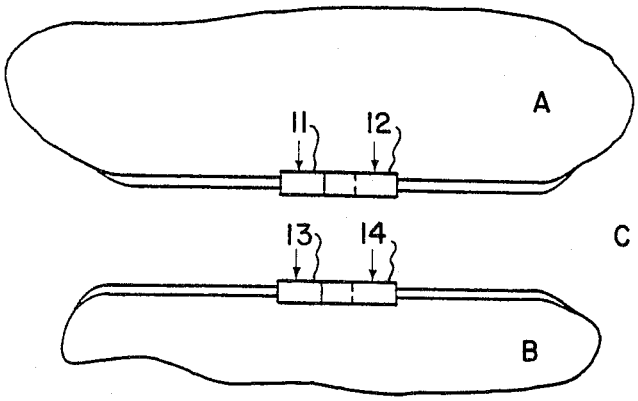
FIGS. 1–3 are diagrams showing two separate volumes closed by fastener systems in FIG. 1, with the fastener systems opened in FIG. 2, and with the volumes connected in FIG. 3 by transferring the fastener systems.
Figure 2:
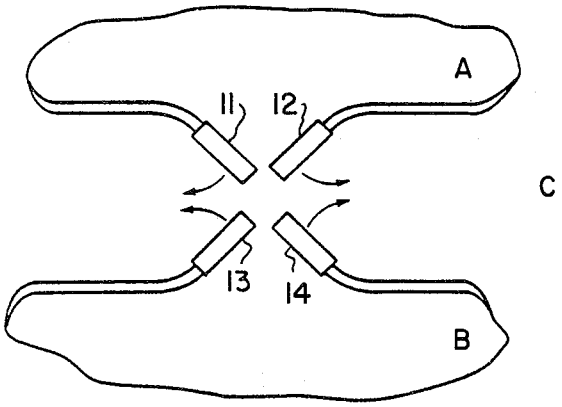
Figure 3:
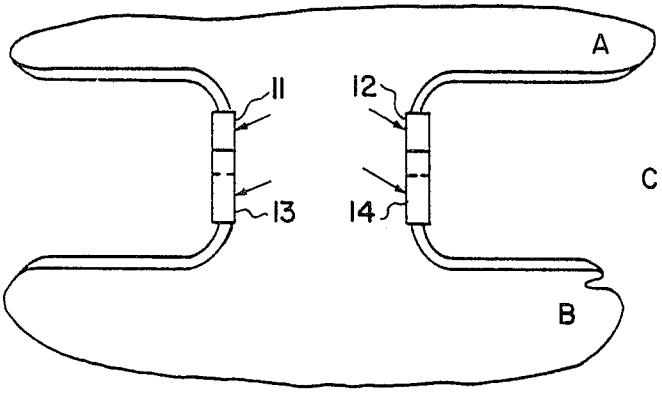

FIGS. 1–3 illustrate one of the general objectives of the invention. In FIG. 1, two volumes A and B are separated from an external environment, C, and also from one another. Both A and B have fastener systems by which the joined tape members 11 and 12 and joined tape members 13 and 14 can be disconnected to allow open exchange with the external environment. FIG. 2 represents the realignment of disconnected tape members from A and B. In FIG. 3 the connection is completed so that tape members 11 and 13 are joined, as well as tape members 12 and 14, to create a single, combined volume of A and B without exposing the enclosed volumes to the external environment. As a result of this joinder a passageway between A and B is completed.

Figure 4:
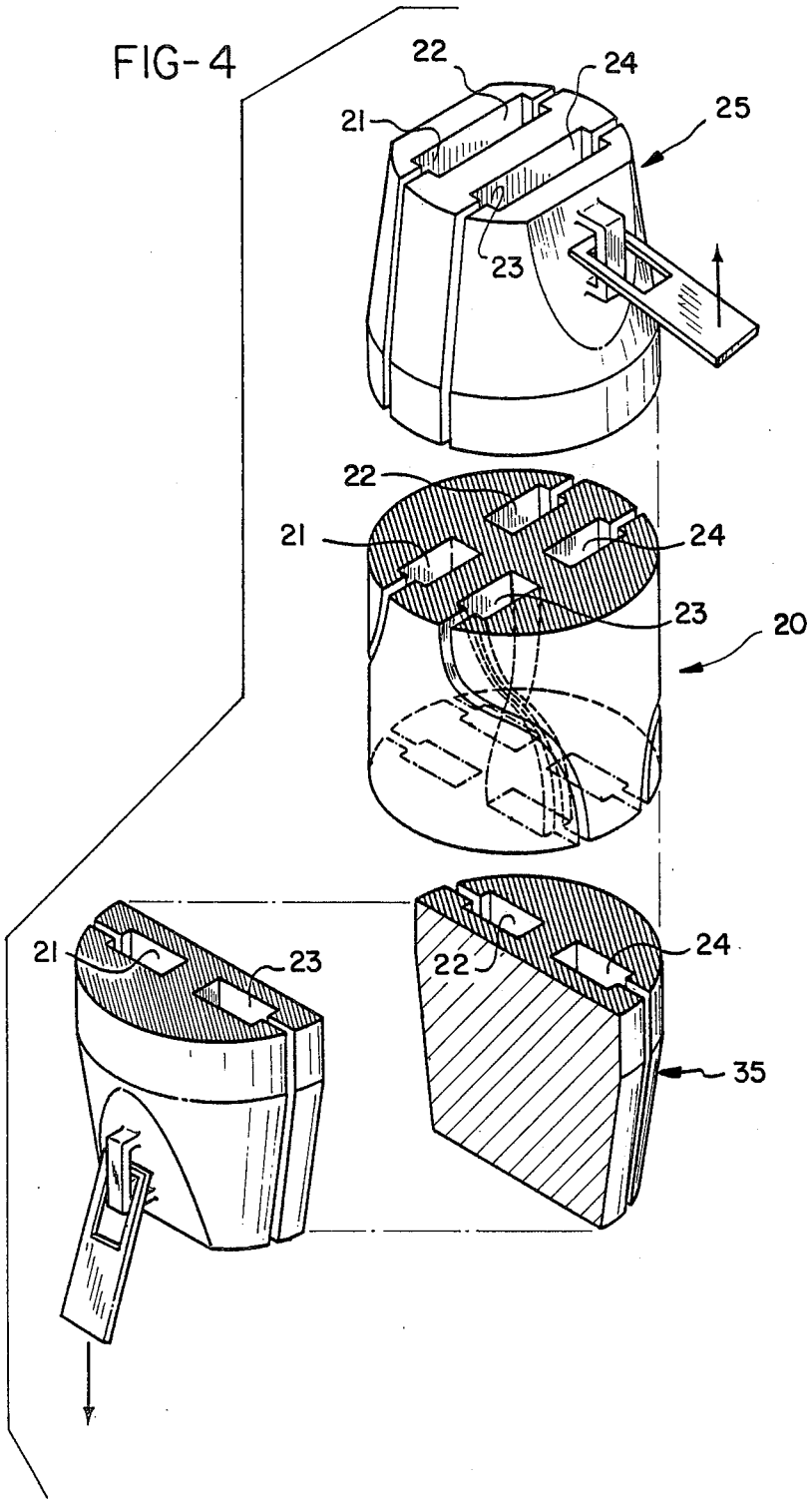
FIG. 4 is an exploded view of the slide member with a pair of cross-sectional separations illustrating the pathways of the channels.

A more detailed example of how this objective is accomplished is illustrated in FIG. 4. For ease in understanding, the embodiment in FIG. 4 is shown as a multipiece member, but it is understood that it is integrated as a single component. To assist in its description, the slide member 20 of the fastener system will be examined as three segments.

The first segment 25 receives two joined tape member pairs (such as tape members 11 and 12, or tape members 13 and 14) through contiguous channels 21 and 22 and contiguous channels 23 and 24. The first segment 25 is of conventional design as described in U.S. Pat. No. 2,229,216 in which the contiguous channels 21–24 diverge at the exit end of the first segment.

The second segment 30 of the slide member is critical to the invention. Each of the four channels 21–24 are twisted approximately 90° in a helical fashion about a vertical axis thus realigning the tape members into new pairs for entry into the third segment.

The third segment 35 of the slide member is basically identical in structure with the first segment. The orientation of the third segment though is different, having been rotated 180° about a horizontal axis and 90° about a vertical axis with respect to the first segment's position. Due to this orientation, the third segment will join the individual tape members into new pairs as described later. The channels merge as 21 and 23, 22 and 24, in the third segment guiding the tape members together. At the exit end of the third segment 35, channels 21 and 23 are now contiguous, as are channels 22 and 24.

Figure 5:
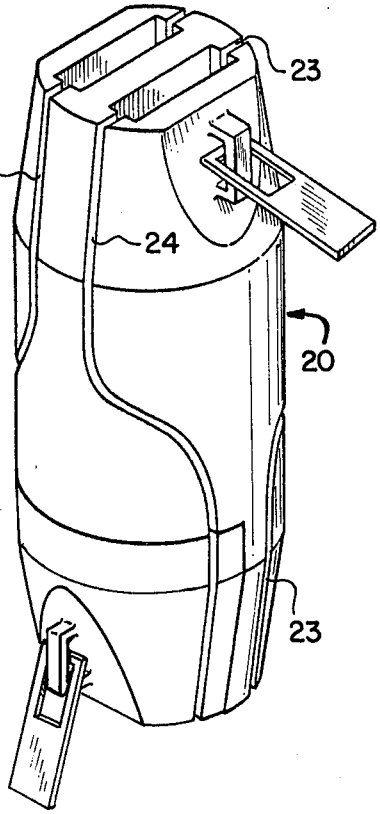
FIG. 5 is a perspective view of the slide member.
Figure 6:
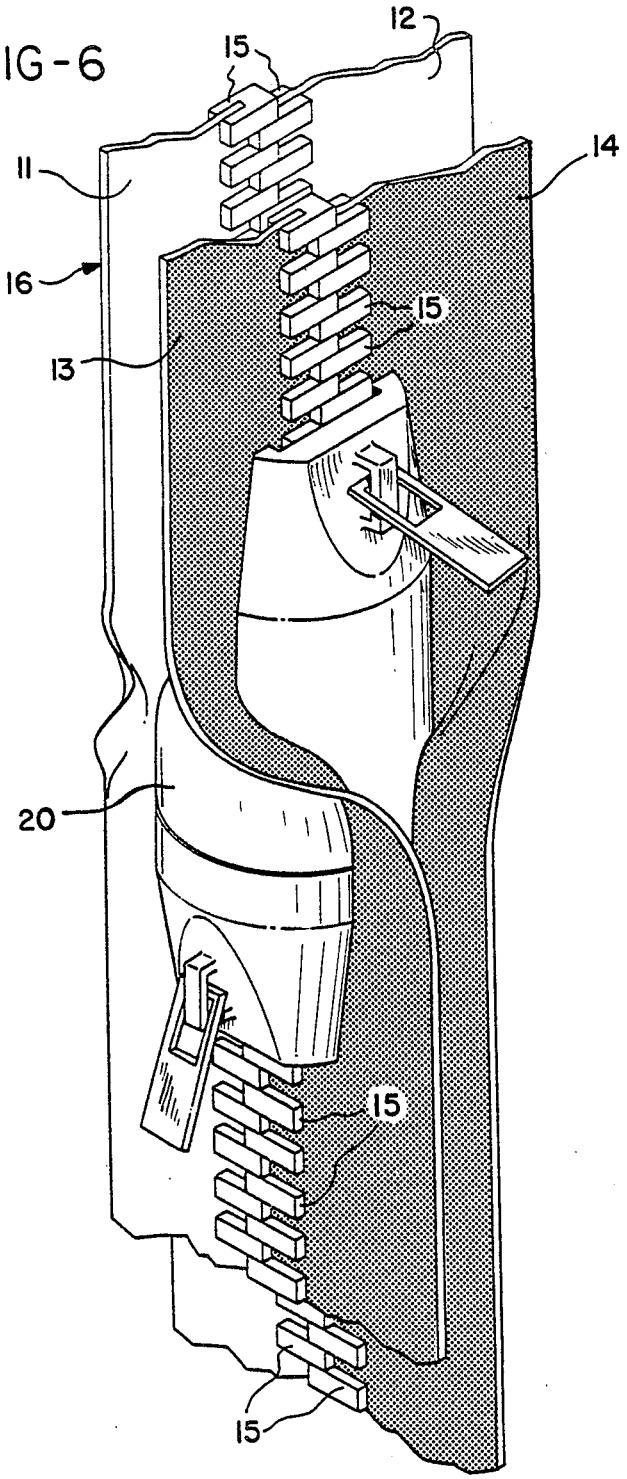
FIG. 6 is the same embodiment as shown in FIG. 5, with zipper tape members inserted.

FIG. 5 is a perspective view of the integrated component described as three separate segments in FIG. 4. The channels 21, 22, 23, 24 are clearly illustrated in this view depicting the path of the tape members through the slide member. In FIG. 6 the pairs of fasteners, which each comprise two tape members (11, 12 and 13, 14 respectively) and compatible interlocking parts 15, are inserted into the slide member embodiment previously described in FIGS. 4 and 5. The tape members are joined by the interlocking parts, here exemplified by zipper teeth although it is understood that the interlocking parts can be of many types. These tape members are paired 11 with 12 and 13 with 14 before entry into the slide member 20. As the slide member moves upward relative to the tape member pairs, as designated by the arrow, the tape pairs 11, 12 and 13, 14 are disconnected as a result of the diverging channels. Midway through the slide member the tape members are no longer connected pairs but instead are four separate members in the process of being twisted or rotated, yet all the tape members are captured and protected from the external environment. The 90° twist of the separate members results in new pairs; the new arrangement pairs tape 11 with 13 and tape 12 with 14. Finally as the channels merge forming contiguous pairs, the interlocking parts 15 of the tape members engage to join the tape pairs as just described.

Figure 7:
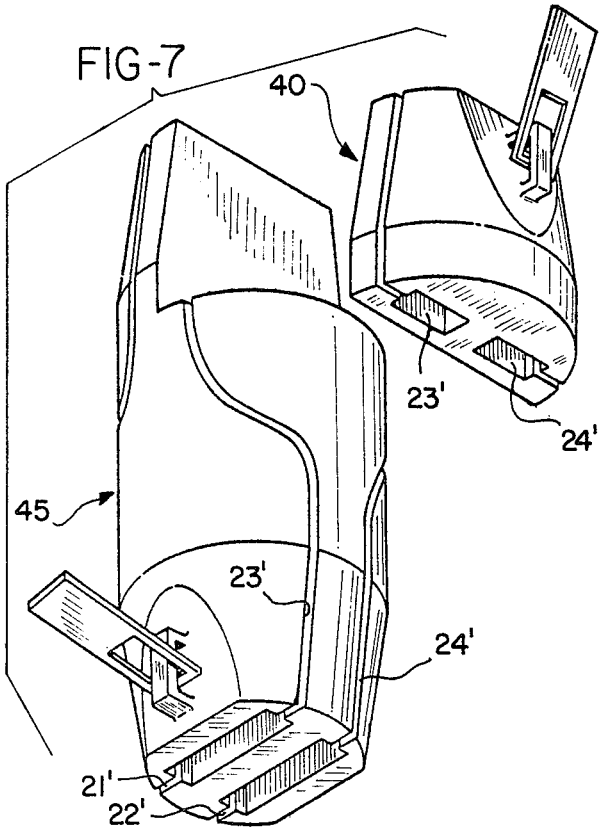
FIG. 7 is another embodiment of the slider, divided into a separate secondary slide and a main slide.

A different embodiment of the present invention is set forth in FIG. 7. Its design and operation is similar to that in FIG. 5 but the slide member involves two separate sections, the secondary tab or slide 40 and the main tab or slide 45, rather than a single integrated piece. Since the embodiment is similar to that described in FIGS. 4–6, like numbers with a prime notation are applied to like parts.

This configuration allows application of the present invention to other practical situations, wherein two panels can remain abutted against one another at will and yet allow for at least one to be independent and mobile. When the panels are detached, the secondary slide 40 is used as a regular zipper slide, so the fastener tapes which it controls can be opened and closed in conventional fashion. Similarly, the primary slide 45 also can be used as a conventional slide to open and close the fastener on the panel with which it remains; see FIGS. 8 and 9. The parts of channels 23' and 24' in the primary and secondary slides are designed to match and, along with channels 21' and 22', receive tape members from a second panel and guide them through the tabs. Without tape members in channels 22' and 24' however the primary slide simply opens and closes the fastener. When the panels are attached (see FIGS. 8–11) the channels 21', 22', 23', and 24' in the combined slide perform the 90° rotation of the tape members to form new tape pairs.

It is of course possible to have a third independent slide component or tab (not shown) comparable to the secondary slide 40, but at the opposite end of the main slide 45. The two secondary slides can function to provide independent control of each fastener, and greater flexibility can be achieved, as might be desired in a topological game or puzzle.

Figures 8, 9, 10, 11:
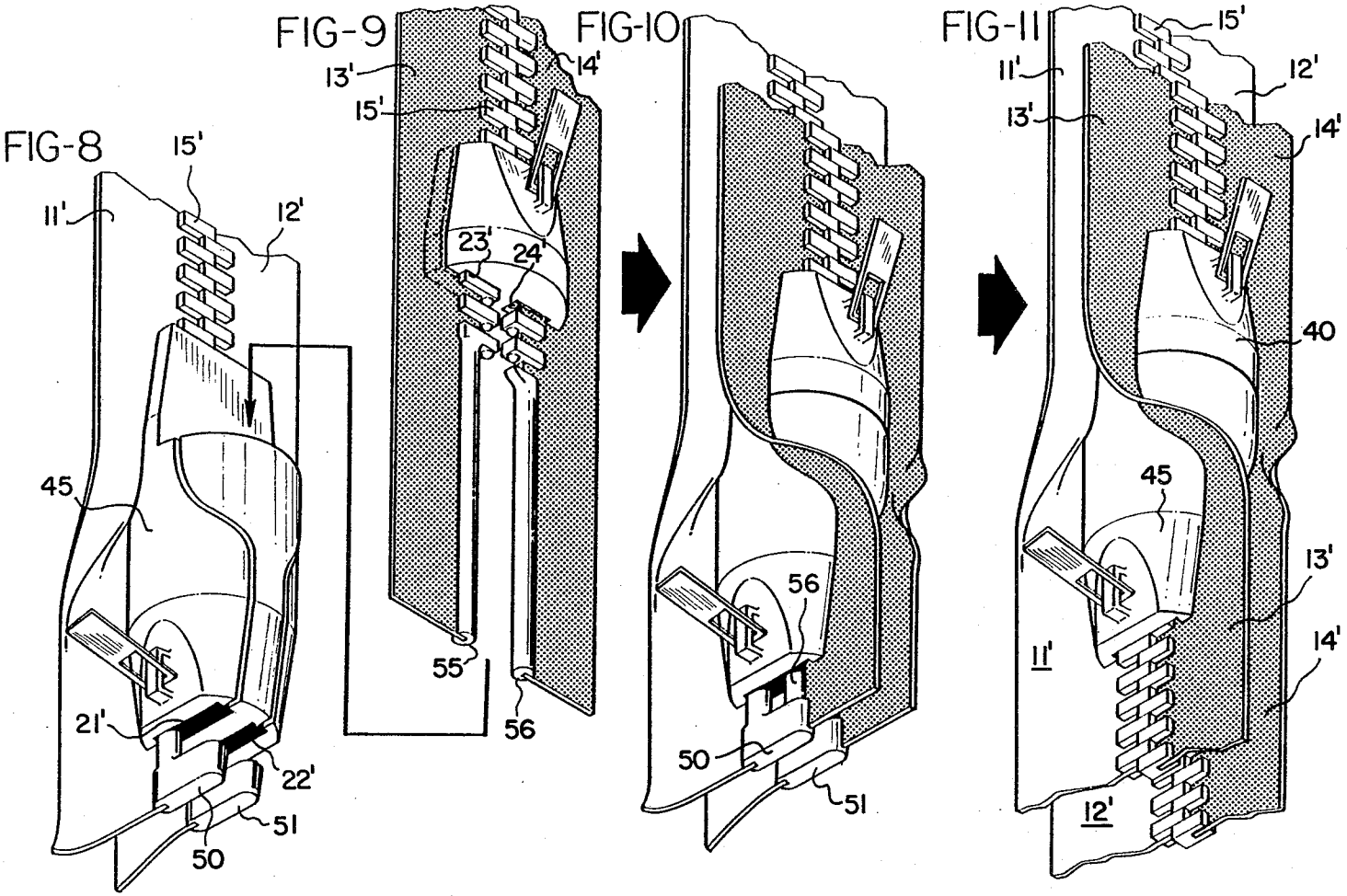
FIGS. 8–11 illustrate in sequence the embodiment in FIG. 7, with FIG. 8 particularly showing the female zipper terminals affixed on the zipper tape members, FIG. 9 showing the affixed male zipper terminals, FIG. 10 showing the secondary slide inserted into the main slide, and FIG. 11 illustrating the secondary and main slides after partial advancement of the tape members through the embodiment.
Figure 12:
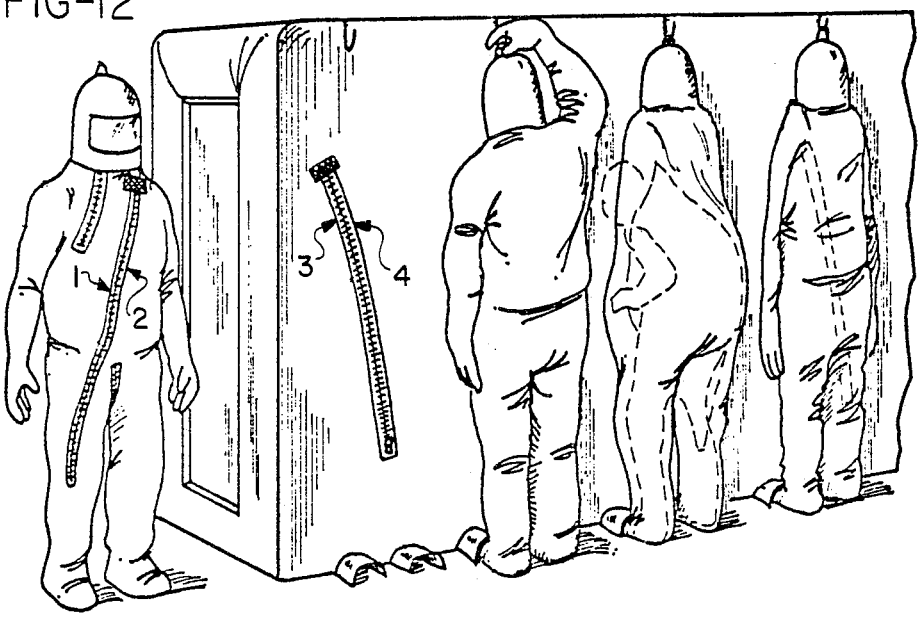
FIG. 12 is a drawing of a shelter compartment and a protective suit showing how the present invention can be used to allow a person to exit a protective suit and enter the compartment without exposure to the external environment.

FIGS. 8–11 illustrate the mechanics of the embodiment illustrated in FIG. 7. Tape members 11' and 12' joined by interlocking parts 15' are shown inserted in the main slide 45 with female end terminals 50 and 51 protruding from channels 21' and 22' at the bottom of FIG. 8. Similarly in FIG. 9, tape members 13' and 14' are shown inserted in the secondary slide 40 with flexible male zipper terminals 55, 56 extending below channels 23' and 24'. The male terminals are designed for insertion into the main parts of channels 23' and 24' in the main slide and are of small enough diameter and sufficient flexibility to pass easily through the channels. FIG. 10 shows the connection that occurs once the male terminals 55, 56 pass through the main slide channels and insert into the female terminals 50, 51. Once connected in this manner the combination main slide and secondary slide perform just like the embodiment of FIGS. 4–6. The realigning of the pairs is further illustrated in FIG. 11 which shows the reversal of the connections of the tape members. In this embodiment it is sometimes desirable to provide a locking device (not shown) joining the main and secondary slides 45 and 40, to prevent their inadvertent separation and resultant exposure of enclosed volumes to the exterior environment.

Figure 13:
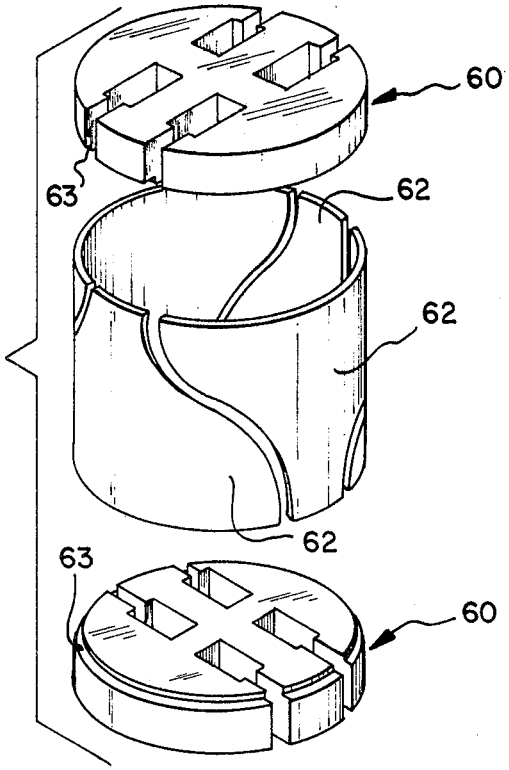
FIG. 13 is an exploded perspective view of other embodiments.

FIG. 13 illustrates another embodiment of the invention in which the central portions of the main slides 20 or 45 are constructed as a shell comprising two identical end pieces 60 attached to and separated by four identical pieces side 62 (two inverted).

The end pieces 60 are rotated 90° with respect to each other, and each contain channels 21'', 22'' and 23'', 24'' for receiving the fastener tapes. These channels can be lengthened and merged, as in FIG. 5, if desired. The end pieces have a ledge 63 which receives the ends of the side pieces 62, and all of these are united, for example with a suitable adhesive. Such a construction has certain cost advantages from a manufacturing cost standpoint, as will be clear to those skilled in this art.

While the method herein described, and the forms of apparatus for carrying this method into effect, constitute preferred embodiments of this invention, it is to be understood that the invention is not limited to this precise method and forms of apparatus, and that changes may be made in either without departing from the scope of the invention, which is defined in the appended claims.

What is claimed is:

1. Apparatus for attaching and detaching two flexible panels, each of said panels being provided with an opening, the side of said openings including mating parts of a continuous flexible fastener strip, comprising an elongated slide member having four generally elongated passages including merging parts of said passages at one end of said slide member adapted to receive said parts of said fastener strips, said passages separating in the central part of said slide member and having parts merging different ones of said passages at the other end of said slide member to bring said fastener strips into contiguous relation with the mating parts arranged such that one part of each fastener strip is mated with an opposite part of the other fastener strip by moving said slide member along said strips simultaneously and progressively separating the mating parts of the fastener strips and joining the parts with opposite parts of the other fastener strip, whereby joining and/or separating the edges of the two openings is accomplished to form and/or close a distendable passage through the panels, said passage being defined by the parts of the two joined fastener strips.

2. Apparatus as defined in claim 1, wherein said slide member includes a separable secondary slide cooperable with one of said fastener strips and capable of joining with the main slide member to assist in transfer of the fastener parts, and of operating on the parts of one fastener strip independently of the main slide member.

3. A fastener system for connecting and disconnecting a pair of flexible panels comprising:

first, second, third, and fourth tape members wherein said first and second tape members can interlock to form one fastener pair adapted to be attached to one of said panels and said third and fourth tape members can interlock to form a second fastener pair adapted to be attached to the other of said panels, interlocking parts associated with each pair of tape members such that one tape member of each pair is compatible for connection with any opposite tape member of the other pair, an elongated slide member having opposed ends and also having first, second, third, and fourth channels extending therethrough from one end to the other to receive and guide said tape members and their associated interlocking parts through joining and separating movements, said first and second channels having merging portions at one end of said slide member wherein said interlocking parts of the first and second tape members are disengaged upon entry into that end of the slide member to separate said first and second tape members, or wherein said interlocking parts are engaged upon exiting said one end of the slide member to join said first and second tape members, said third and fourth channels having merging portions at said one end of said slide member wherein said interlocking parts of the third and fourth tape members are disengaged upon entry into that end of the slide member to separate said third and fourth tape members, or wherein said interlocking parts are engaged upon exiting said one end of the slide member to join said third and fourth tape members, said four channels having separated central portions in said slide member for quiding all four of said tape members in spaced relation, said first and third channels having merging portions at the other end of said slide member wherein said interlocking parts of said first and third tape members are disengaged upon entry into the other end of the slide member to separate said first and third tape members, or wherein said interlocking parts are engaged upon exiting the other end of the slide member to join said first and third tape members, said second and fourth channels having merging portions at the other end of said slide member wherein said interlocking parts of said second and fourth tape members are disengaged upon entry into the other end of the slide member to separate said second and fourth tape members, or wherein said interlocking parts are engaged upon exiting the other end of the slide member to join said second and fourth tape members.

4. A fastener system as defined in claim 3, wherein said slide member comprises a main slide and a secondary slide detachable from said main slide, said secondary slide having first and second merging channels capable of mating with said main slide along the central portions of its first and second channels and merging at one end of said secondary slide for joining and separating said first and second tape members, first and second female terminals attached to an end of said third and fourth tape members, and first and second male terminals attached to an end of said first and second tape members and of small enough diameter to pass through said first and second channels of said main slide and engage with said first and second female terminals respectively.

5. The method of attaching and detaching two flexible panels, each of which is provided with an opening, the sides of which include mating parts of a continuous flexible fastener strip, comprising the steps of bringing the fastener strips into contiguous relation with the mating parts arranged such that one part of each fastener strip is capable of mating with an opposite part of the other fastener strip, simultaneously and progressively separating the mating parts of the fastener strips and joining the parts with opposite parts of the other fastener strip, thereby joining and/or separating the edges of the two openings and forming and/or closing a distendable passage through the panels which is defined and enclosed by the parts of the two joined fastener strips.

6. The method of claim 5, wherein the mating parts of the fastener strips are twisted through approximately 90° in the step of separating them and joining them to a part of the other strip.

* * * * *